US007708001B2

(12) United States Patent
Kempf

(10) Patent No.: US 7,708,001 B2
(45) Date of Patent: May 4, 2010

(54) BOW

(76) Inventor: James J. Kempf, 3201 12th Ave., Coralville, IA (US) 52241

( * ) Notice: Subject to any disclaimer, the term of this patent is extended or adjusted under 35 U.S.C. 154(b) by 368 days.

(21) Appl. No.: 11/386,653

(22) Filed: Mar. 22, 2006

(65) Prior Publication Data

US 2007/0221184 A1 Sep. 27, 2007

(51) Int. Cl.
*F41B 5/10* (2006.01)

(52) U.S. Cl. ..... 124/25.6

(58) Field of Classification Search ..... 124/23.1, 124/25, 25.6, 86, 88

See application file for complete search history.

(56) References Cited

U.S. PATENT DOCUMENTS 2,100,317 A 11/1937 Hickman
2,957,470 A 10/1960 Bama
3,238,935 A 3/1966 Stanaland
3,515,113 A 6/1970 Lawrence
4,722,317 A 2/1988 Hartwig
4,976,250 A 12/1990 Jeffrey
5,630,405 A 5/1997 Nizov
6,155,243 A 12/2000 Gallops, Jr.
6,267,108 B1 7/2001 McPherson et al.
RE37,544 E * 2/2002 Darlington ..... 124/25.6
6,460,528 B1 10/2002 Gallops, Jr.
6,966,312 B1 * 11/2005 Larson ..... 124/25.6

* cited by examiner

*Primary Examiner*—John Ricci
(74) *Attorney, Agent, or Firm*—Brett Trout

(57) ABSTRACT

A bow having an increased powerstroke allowing for reduced draw weight and increased speed. The bow is provided with a riser and a pair of limbs. A pulley is coupled to one limb and a cam is coupled to the other at a first journal point and second journal point respectively. The powerstroke is increased by locating the bowstring on the pulley and cam between the riser and the journal points.

13 Claims, 4 Drawing Sheets

BOW

BACKGROUND OF THE INVENTION

1. Field of the Invention

The present invention relates in general to an improved bow and particularly to a bow having an improved powerstroke.

2. Description of the Prior Art

Bows are well known in the art. Over the past several decades, bows have been consistently improved with technological innovations which have dramatically increased performance. One improvement has been the provision of cams on the bow to increase the mechanical advantage associated with the draw of the bowstring. One drawback associated with such cams is the requirement that cams be "synchronized" to prevent lateral travel of the rear of the arrow during launch. Accordingly, the prior art has utilized a single cam arrangement in association with a pulley, such as that described in McPherson, U.S. Pat. No. 6,267,108, which substantially reduces the problem associated with "synchronization" and rear travel of the arrow.

For climbing into trees and hunting in thick woods, it is desirable to have a small, lightweight bow. However, reducing the length of the bow risers, and/or sweeping the risers in a more rearward orientation, often reduces the draw length and powerstroke of the bow. Reducing the powerstroke simultaneously sacrifices speed and increases the draw weight required to obtain the desired performance. Accordingly, it would be desirable to provide a lightweight, compact bow with an increased powerstroke, greater speed and reduced draw weight. The difficulties encountered in the prior art discussed hereinabove are substantially eliminated by the present invention.

SUMMARY OF THE INVENTION

In the advantage provided by this invention, a bow is provided which is of a low-cost, simple manufacture.

Advantageously, this invention provides a bow of a compact, lightweight construction.

Advantageously, this invention provides a bow with an increased powerstroke.

Advantageously, this invention provides a bow which reduces the force required to draw the bowstring.

Advantageously, in the preferred embodiment of this invention, a bow is provided with a pair of limbs extending upwardly and rearwardly from a riser. A pulley is coupled to one riser while a cam is coupled to the other. A first string is coupled between the pulley and cam, as is a second string which is located on the side of the pulley and cam closest to the riser. An arrow is notched to the second string, which is drawn and fired. By utilizing the second string to launch the arrow, and drawing the second string from the forward portion from the cam and pulley, the powerstroke is increased, thereby allowing increased speed of the arrow with a reduction in the effort required to launch the arrow.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
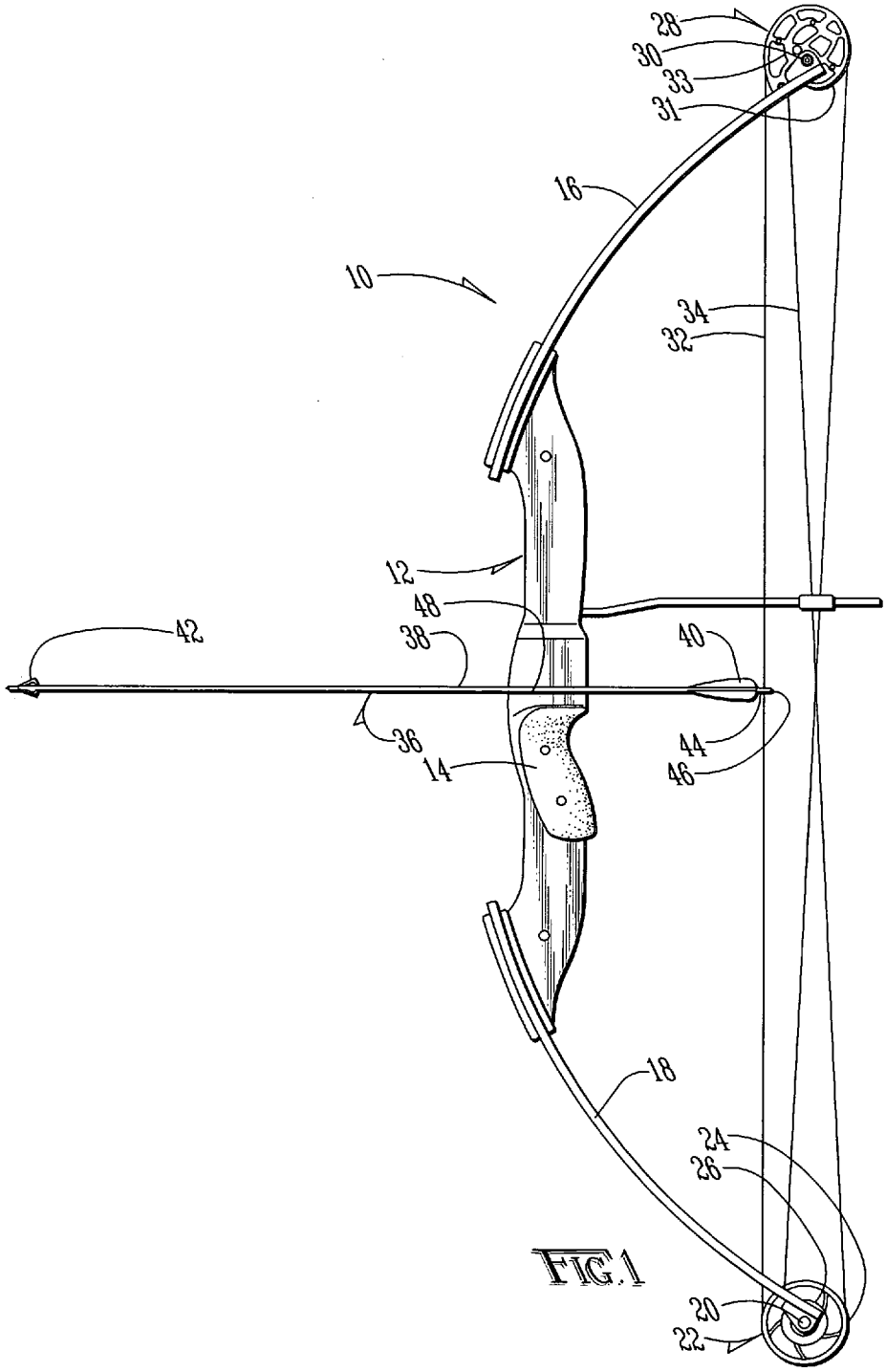
FIG. 1 illustrates a side elevation of the improved bow of the present invention.
Figure 2:
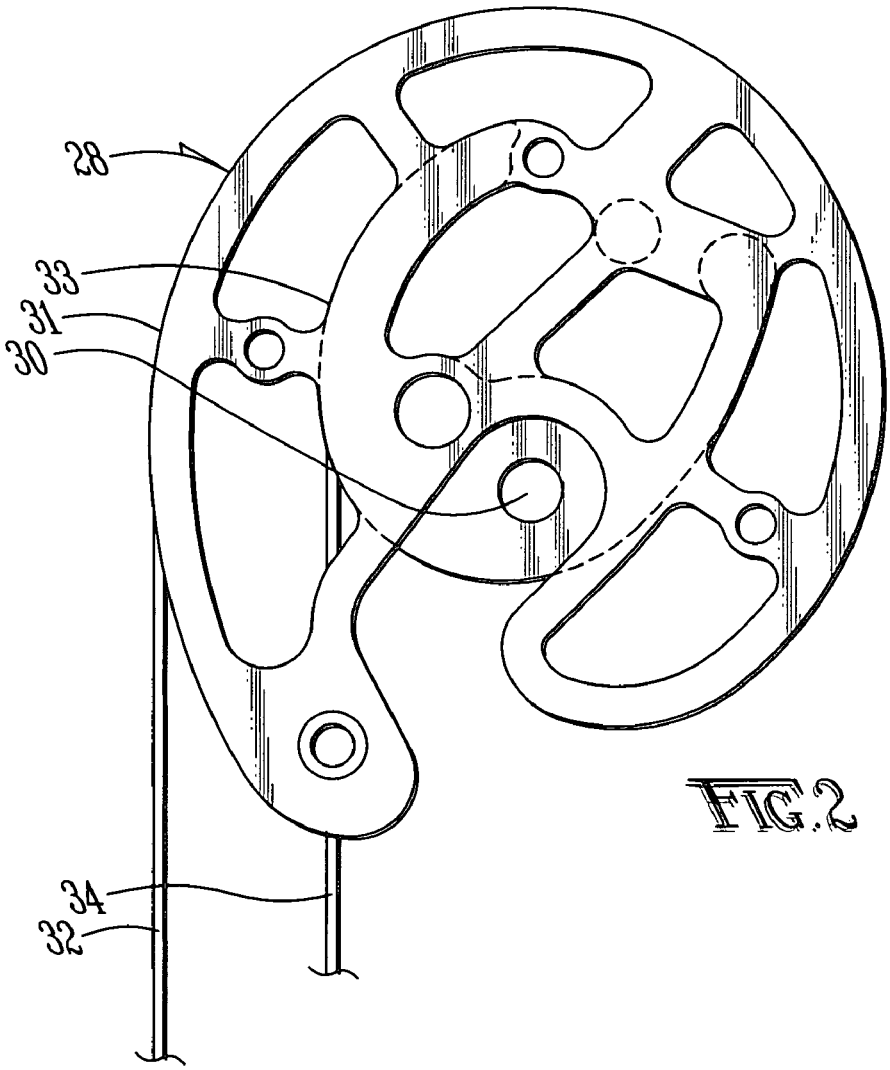
FIG. 2 illustrates a side elevation of the cam associated with the improved bow.

A bow according to the present invention is shown generally as (10) in FIG. 1. The bow (10) includes a riser (12) provided with a handle (14) in a manner such as that known in the art. Coupled to the riser (12) is a first limb (16) and second limb (18). A pulley is journaled to the first limb (16) with an axle (20) which acts as journal point. The pulley (22) has an outer track (24) and an inner track (26). The pulley (22) is preferably journaled to the first limb (16) in a manner which positions a portion of the pulley (22) rearward and outward of the space defined between the limbs (16) and (18). As shown in FIG. 1, a second string guide, which in the preferred embodiment is a cam (28), is journaled to the second limb (18) at a second journal point (30). The cam (28) is journaled to the second limb (18) so that at least a portion of the cam (28) extends rearward and outward of the area defined between the limbs (16) and (18). The cam (28) is preferably constructed as shown in FIG. 2, having an outer track (31) and an inner track (33), but may be constructed in any manner known in the art. If desired, an additional cam (not shown) synchronized with the cam (28) may be used in place of the pulley (22).

Figure 3:
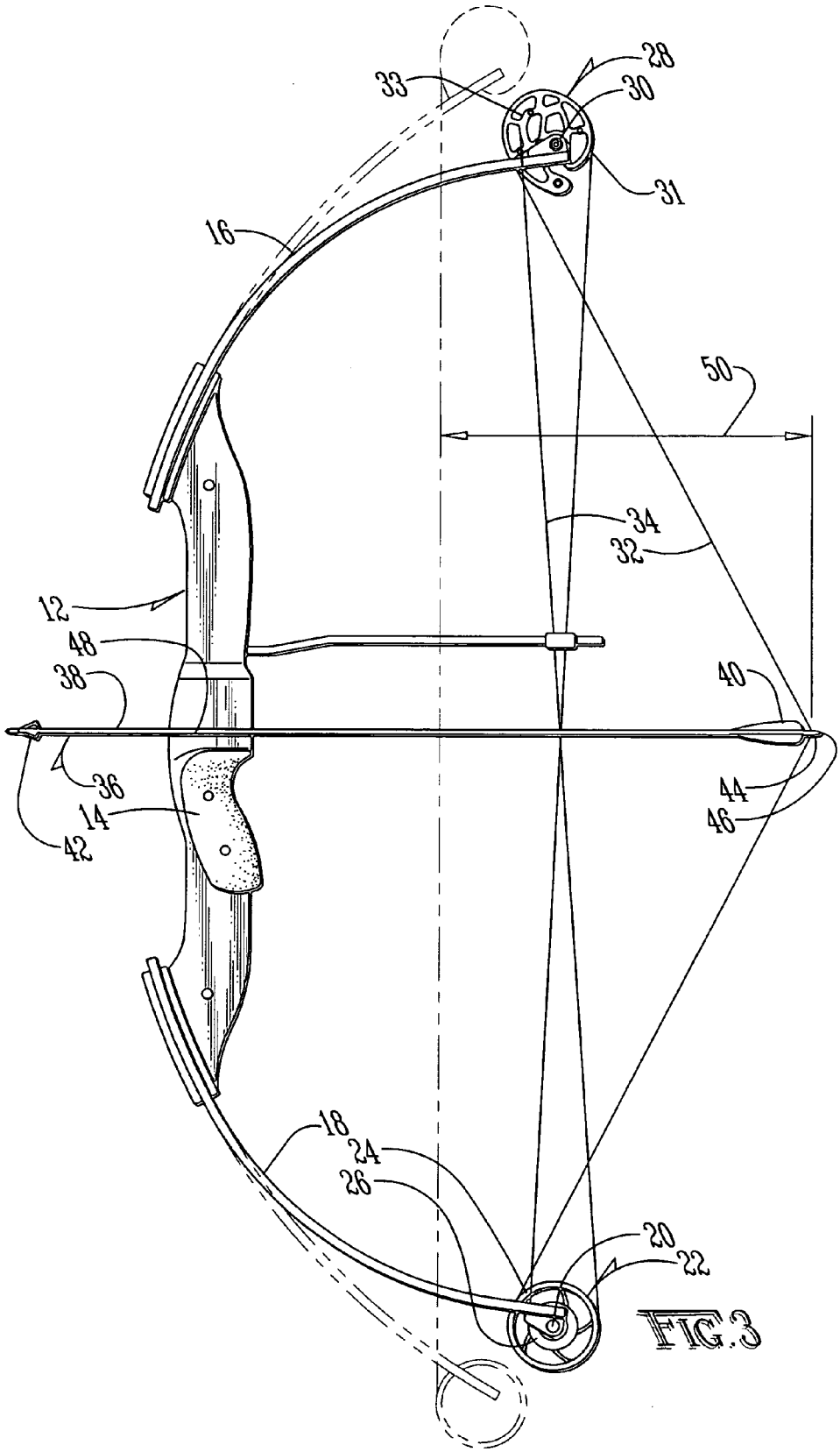
FIG. 3 illustrates a side elevation of the improved bow of FIG. 1, shown drawn with an arrow.

The cam (28) and pulley (22) may be coupled to a bowstring (32) and, if desired, one or more cables(34) in any manner known in the art, but the bowstring (32) is preferably located, as shown in FIG. 1, forward of the first axle (20) and second axle (30). When the bowstring (32) is drawn, as shown in FIG. 3, the bowstring (32) contacts the pulley (22) and cam (28) at points located between the first axle (20) and second axle (30).

As shown in FIG. 1, the foregoing orientation of the pulley (22), cam (28), cable (34) and bowstring (32) in the rest position between the axles (20) and (30), and the riser (12). When it is desired to utilize the bow (10) of the present invention, an arrow (36) having a shaft (38), flights (40), a head (42) and a nock (44) is provided. The nock (44) is coupled to a nock point (46) provided in the bowstring (32). The shaft (38) of the arrow (36) sits upon the arrow rest (48) provided on the riser (12). The arrow (36) is thereafter drawn rearward by the nock (44) as shown in FIG. 3. By threading the bowstring (32) across the forward and upward portion of the pulley (22) and forward and downward portion of the cam (28), the draw length of the bow (10) is increased over a prior art bow, thereby increasing the powerstroke and speed of the arrow (36) upon release, while decreasing the effort required to draw the arrow (36) to the full draw length (50). Once the full draw length (50) has been obtained, the nock (44) may be released, thereby launching the arrow (36) at the desired target.

Figure 4:
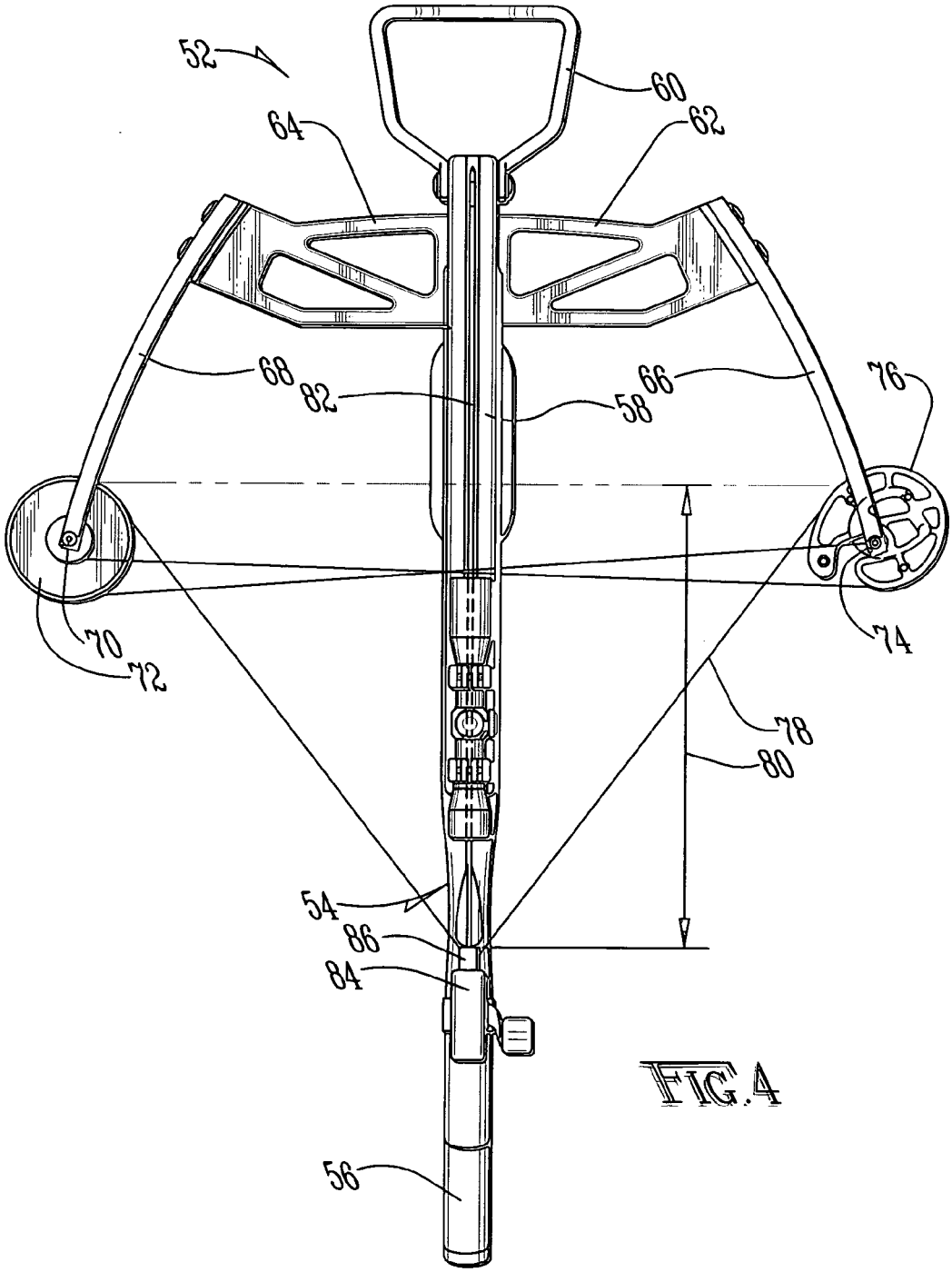
FIG. 4 illustrates a top elevation of an alternative embodiment utilizing the present invention in the form of a crossbow.

An alternative embodiment of the present invention is shown generally as a crossbow (52) in FIG. 4. The crossbow (52) is provided with a frame (54) which includes a stock (56) and a rail (58). Although the stock (56) and rail (58) may be of any type known in the art, in the preferred embodiment, the stock (56) is of a composite material construction and the rail (58) is constructed of aluminum. Alternatively, the crossbow (52) may be of a "rail-less" design, such as those known in the art.

The crossbow (52) is provided with a pivotable foot stirrup (60) to facilitate cocking of the crossbow (52). As shown in FIG. 4, the crossbow (52) is also provided with a pair of risers (62) and (64) secured to the rail (58). The risers (62) and (64) are preferably constructed of aluminum to reduce weight. Coupled to the risers (62) and (64) are a first limb (66) and a second limb (68). The limbs (66) and (68) are constructed and coupled to the risers (62) and (64) in a manner such as that known in the art. Journaled to the first limb (66) at a first journal point (70) is a pulley (72). Journaled to the second limb (68) at a second journal point (74) is a cam (76). As described above, the crossbow (52) is provided with a bowstring (78) coupled to the pulley (72) at a position located between the first journaled point (70) and the riser (62). Similarly, the bowstring (78) is coupled to the cam (76) at a position located between the second journal point (74) and the riser (64). By locating the bowstring (78) forward and inward of the both the pulley (72) and cam (76), the power-stroke (80) of the crossbow (52) is increased, which increases the speed of a bolt (82) launched by the crossbow (52), and decreasing the draw weight associated with cocking the crossbow (52).

As shown in FIG. 4, when it is desired to operate the crossbow (52), the foot stirrup (60) is engaged and the bowstring (78) is pulled to engage the bowstring (78) with the catch mechanism (84). The bolt (82) is then placed upon the rail (58). A trigger assembly (86) such as that known in the art is thereafter actuated to release the catch mechanism (84) and cause the bowstring (78) to propel the bolt (82) along the rail (58) and toward the desired target.

Although the invention has been described with respect to a preferred embodiment thereof, it is also to be understood that it is not to be so limited, since changes and modifications can be made therein which are within the full, intended scope of this invention as defined by the appended claims. As an example, the bow (10) of the present invention may be utilized in association with two cams. Another alternative anticipated by the present invention is a bow having the riser and limbs integrally formed of a single unit.

What is claimed is:

1. A shooting bow comprising:

(a) a bow comprising:

(i) a riser;

(ii) a first limb extending from said riser in a direction away from a direction of shooting; and (iii) a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide forward of said first journaling means to a second point on said second string guide forward of said second journaling means;

(h) a nock point provided on said second string, and (i) wherein said first string is integrally formed with said second string.

2. The shooting bow of claim 1, further comprising a handle coupled to said riser.

3. A shooting bow and arrow system comprising:

(a) a bow comprising:

i. a riser;

ii. a first limb extending from said riser in a direction away from a direction of shooting; and iii. a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide forward of said first journaling means to a second point on said second string guide forward of said second journaling means;

(h) an arrow extending from said second string to said riser, and (i) wherein said arrow is coupled to said second string at a point rearward of said first string guide and said second string guide.

4. The shooting bow and arrow system of claim 3, wherein said arrow is coupled to said second string at a point rearward of said first string guide and said second string guide, and wherein said first point on said first string guide and said second point on said second string guide are located between said first journaling means and said second journaling means.

5. A shooting bow comprising:

(a) a bow comprising:

(i) a riser;

(ii) a first limb extending from said riser in a direction away from a direction of shooting; and (iii) a second limb extending from said riser in a direction away from a direction of shooting;

(b) a first string guide, wherein said first string guide is a cam;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide forward of said first journaling means to a second point on said second string guide forward of said second journaling means;

(h) a nock point provided on said second string; and (i) wherein said second string guide is a pulley.

6. A shooting bow comprising:

(a) a bow comprising:

(i) a riser;

(ii) a first limb extending from said riser in a direction away from a direction of shooting; and (iii) a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide forward of said first journaling means to a second point on said second string guide forward of said second journaling means; and (h) means for retaining said second string in a cocked position.

7. The shooting bow of claim 6, further comprising a trigger coupled to said second string.

8. The shooting bow of claim 7, further comprising a projectile track coupled to said riser.

9. A shooting bow comprising:

(a) a bow comprising:

(i) a riser;

(ii) a first limb extending from said riser in a direction away from a direction of shooting; and (iii) a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide to a second point on said second string guide;

(h) wherein said first point is located between said riser and said first string guide journaling means;

(i) wherein said second point is located between said riser and said second string guide journaling means (j) a nock point provided on said second string; and (k) wherein said first string is integrally formed with said second string.

10. A shooting bow comprising:

(a) a bow comprising:

(i) a riser:

(ii) a first limb extending from said riser in a direction away from a direction of shooting; and (iii) a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide (g) a second string coupled from a first point on said first string guide to a second point on said second string guide;

(h) wherein said first point is located between said riser and said first string guide journaling means;

(i) wherein said second point is located between said riser and said second string guide journaling means;

(j) a nock point provided on said second string; and (k) wherein said first point is located at the point where said second string first contacts said first string guide, wherein said second point is located at the point where said second string first contacts said second string guide, and wherein said first string guide is a cam.

11. The shooting bow of claim 10, wherein said second string guide is a pulley.

12. A shooting bow comprising:

(a) a bow comprising:

(i) a riser;

(ii) a first limb extending from said riser in a direction away from a direction of shooting; and (iii) a second limb extending from said riser in a direction away from a direction of shooting;

(b) a first string guide;

(c) means for journaling said first string guide to said first limb;

(d) a second string guide;

(e) means for journaling said second string guide to said second limb;

(f) a first string coupled to said first string guide and to said second string guide;

(g) a second string coupled from a first point on said first string guide to a second point on said second string guide;

(h) wherein said first point is located between said riser and said first string guide journaling means;

(i) wherein said second point is located between said riser and said second string guide journaling means;

(j) wherein said second string guide is a cam; and (k) wherein said first point is located at the point where said second string first contacts said first string guide, wherein said second point is located at the point where said second string first contacts said second string guide, and wherein said first string guide is a cam.

13. A shooting bow comprising:

(a) a riser;

(b) a first limb extending from said riser;

(c) a second limb extending from said riser;

(d) a cam journaled to said first limb at a first journal point;

(e) a pulley journaled to said second limb at a second journal point;

(f) a first string coupled to said cam and to said pulley;

(g) a second string coupled from a first string point on said cam to a second string point located on said pulley;

(h) wherein when said second string is uncocked, said first string point is located between said riser and said first journal point and said second string point is located between said riser and said second journal point, and (i) wherein when said second string is cocked, said first string point and said second string point are located between said first journal point and said second journal point.

* * * * *